US008172106B2

(12) United States Patent
Clamp et al.

(10) Patent No.: US 8,172,106 B2
(45) Date of Patent: May 8, 2012

(54) LAMINATED PULP DISPOSABLE PAINT TRAY

(76) Inventors: Eric Clamp, Western Springs, IL (US); Jack Terrazas, San Antonio, TX (US); Jason Lin, Yi Lan County (TW)

( * ) Notice: Subject to any disclaimer, the term of this patent is extended or adjusted under 35 U.S.C. 154(b) by 335 days.

(21) Appl. No.: 12/194,875

(22) Filed: Aug. 20, 2008

(65) Prior Publication Data

US 2009/0265875 A1 Oct. 29, 2009

Related U.S. Application Data

(60) Provisional application No. 60/965,400, filed on Aug. 20, 2007.

(51) Int. Cl.
*B65D 25/14* (2006.01)
*B44D 3/12* (2006.01)
*B05C 21/00* (2006.01)

(52) U.S. Cl. ..... 220/570; 220/495.02; 428/34.2; 15/257.06

(58) Field of Classification Search ..... 220/495.02, 220/570; 428/34.2, 156, 479.3, 479.6, 481, 428/511, 512, 513; 15/257.06
See application file for complete search history.

(56) References Cited

U.S. PATENT DOCUMENTS

| | | | | |
|---|---|---|---|---|
| 2,972,765 | A * | 2/1961 | Macy et al. | 15/257.06 |
| 7,435,483 | B2 * | 10/2008 | Lee et al. | 428/481 |
| 7,721,910 | B2 * | 5/2010 | Wallace | 220/570 |
| 2006/0037960 | A1 * | 2/2006 | Rosa | 220/495.02 |

* cited by examiner

*Primary Examiner* — Anthony Stashick
*Assistant Examiner* — Madison L Wright

(57) ABSTRACT

Recycled paper pulp is processed to form a rigid paint tray base. The paint tray base is then laminated with a film, which may be fully or partially recyclable and/or biodegradable. The film prevents saturation of the pulp from the paint's moisture, which would damage the integrity of the pulp. Once the painting is completed, the film may be separated from the pulp base. The pulp base may then be discarded with waste-paper or used for compost. The film may be recycled or disposed of with other non-biodegradable waste.

6 Claims, 7 Drawing Sheets

LAMINATED PULP DISPOSABLE PAINT TRAY

CROSS REFERENCE TO RELATED APPLICATIONS

This application claims priority to U.S. provisional application 60/965,400, filed Aug. 20, 2007 with the title "LAMINATED PULP DISPOSABLE PAINT TRAY," which is incorporated herein by reference.

U.S. Pat. No. 4,337,116 issued to Foster et al. on Jun. 29, 1982 is herein incorporated by reference.

Publication WO/2001/074564 by Frederiksen et al., with the title "Method and Apparatus for Producing Moulded Pulp Articles with a Plastic Film Laminated Thereon," and published Oct. 11, 2001 is herein incorporated by reference.

BACKGROUND

This invention relates to the area of disposable paint trays and, more particularly, to a biodegradable disposable paint tray made from molded pulp and coated or laminated with recycled polyethylene or other poly laminate material or bio film.

Painters use trays to hold usable quantities of paint for rollers and brushes. A tray's reservoir typically holds 1 to 3 quarts of paint. Most paint trays are made of metal, non-biodegradable plastic or other similar materials. But because paint trays are often time consuming, messy and difficult to clean and maintain, many painters prefer disposable trays, which they use only once or until a specific project is completed, and then discard. While disposable trays are convenient and efficient, they contribute to the growing problem of waste produced throughout the world, and particularly in the United States.

The waste problem is less severe when refuse is biodegradable and/or recyclable. But disposable paint trays are generally made of rigid plastic, which is made from synthetic petrochemical compounds formulated in a laboratory. The combinations of elements formed do not exist in nature, so there is no corresponding microorganism that is able to process them. So once the plastic product is formed, no process of nature can break it back down into the petroleum resins from which it is made. So the refuse, once buried, persists forever.

In contrast, products in a relatively natural form will quickly decompose and return to nature. So natural plant, animal or mineral-based products biodegrade quickly. And molded pulp products are among the most quickly biodegradable products known. Generally they take only two to five months to fully biodegrade under normal conditions.

Molded pulp is made from recycled paper pulp fiber, which is a post-consumer waste byproduct. It is already used in many applications. For example, fast food restaurants use molded pulp drink trays to help customers carry multiple cups. Manufacturers use molded pulp for product packaging in the forms of rigid end caps, corner guards, trays, bracing and blocking to provide structural integrity and protect goods from damage during transport. Distributors use it for pallets, stacking and packaging. And because of its biodegradability, gardeners use it as a container for plants.

Beside biodegradability, molded pulp provides the added benefit of using recycled material. This is beneficial because paper accounts for approximately 40% of municipal waste. In fact, the United States alone uses more than 100 million tons of paper each year. The paper industry is the third largest consumer of energy in the United States, and is one of the largest water polluters in the world.

But recycled paper ameliorates many of these deleterious impacts. For example, recycled paper uses 60-70% less energy to produce than virgin pulp. It uses 55% less water, reduces water pollution by 35%, reduces air pollution by 74% and eliminates many toxic pollutants. And recycled pulp helps preserve forests by reducing the need for loggers to cut new timber.

A biodegradable disposable paint tray is desirable, but the inherent properties that make molded pulp earth-friendly also make it a poor paint receptacle. Molded pulp is very porous and quickly absorbs moisture. Saturated with moisture, molded pulp loses its rigidity and begins to deteriorate. It is therefore desirable to provide a product that combines the biodegradability of molded pulp with the utility of a plastic paint tray.

OBJECTS OF THE INVENTION

It is an object of the invention to provide a paint tray and other commercial and residential products that are environmentally friendly.

It is a further object of the present invention to provide an environmentally friendly commercial and residential product made from paper pulp fiber that has been recycled and that is biodegradable, as well as from a poly film laminate which may be 100% recyclable and may be either partially or fully biodegradable.

It is yet another object of the present invention to provide for a novel commercial or residential article that is comprised of two portions, a molded pulp portion and a laminated portion, which is snugly joined to the molded pulp portion, but which a user may also easily separate and remove from the pulp portion. This allows the user to discard the molded pulp portion in a wastepaper bin or to use it as compost, while the laminated portion may be recycled with other non-biodegradable goods.

It is another object of the present invention to provide a novel paint tray or other commercial and/or residential article that is at least partially water resistant and maintains its structural integrity throughout use.

DETAILED DESCRIPTION OF PREFERRED EMBODIMENTS

The present invention provides a disposable paint tray that combines the biodegradability of molded pulp with the utility of a recyclable and biodegradable plastic paint tray.

Certain types of poly film are at least partially degradable. These include polyethylene teraphthalate (PET), polypropylene (PP), polyethylene (PE) or bio film like polylactic acid (PLA). PLA is 100% biodegradable. Others may be partly biodegradable. For example, PE may come as low-density polyethylene (LDPE) or high-density polyethylene (HDPE), and may be made 20~40% biodegradable by adding starch during the production process. In one example, PE laminate film with these additives has been found to be approximately 40% biodegradable and to have heat forming qualities (softening between 300 and 400 degrees) and elongation. Nylon may also be suitable as a film material in certain situations.

Figure 1:
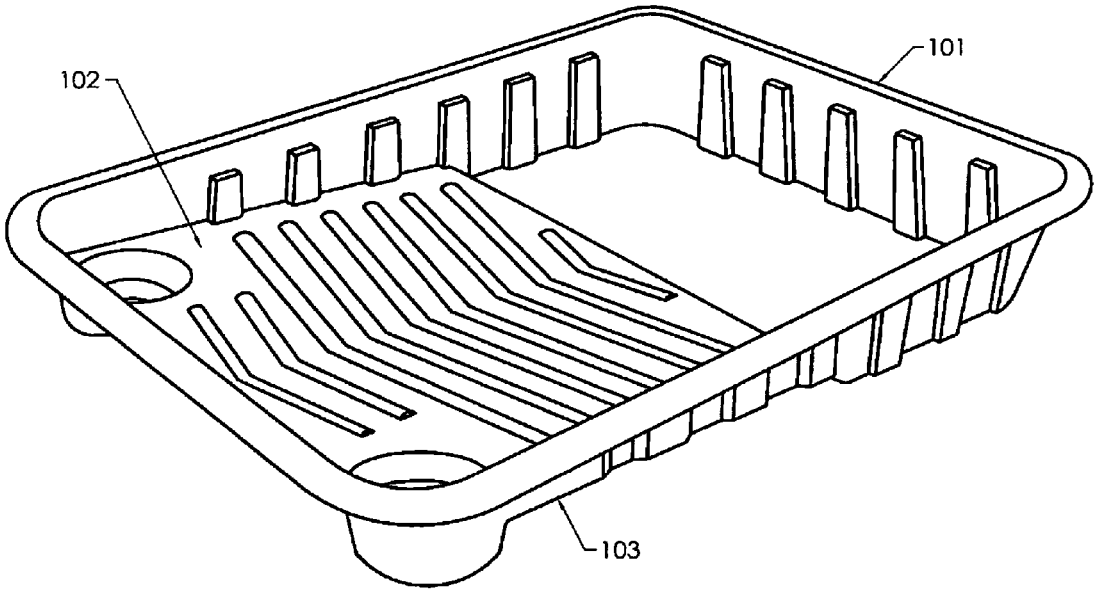
FIG. 1 is a drawing of a paint tray comprised of molded pulp laminated with recycled polyethylene in accordance with a preferred embodiment of the present invention.
Figure 2:
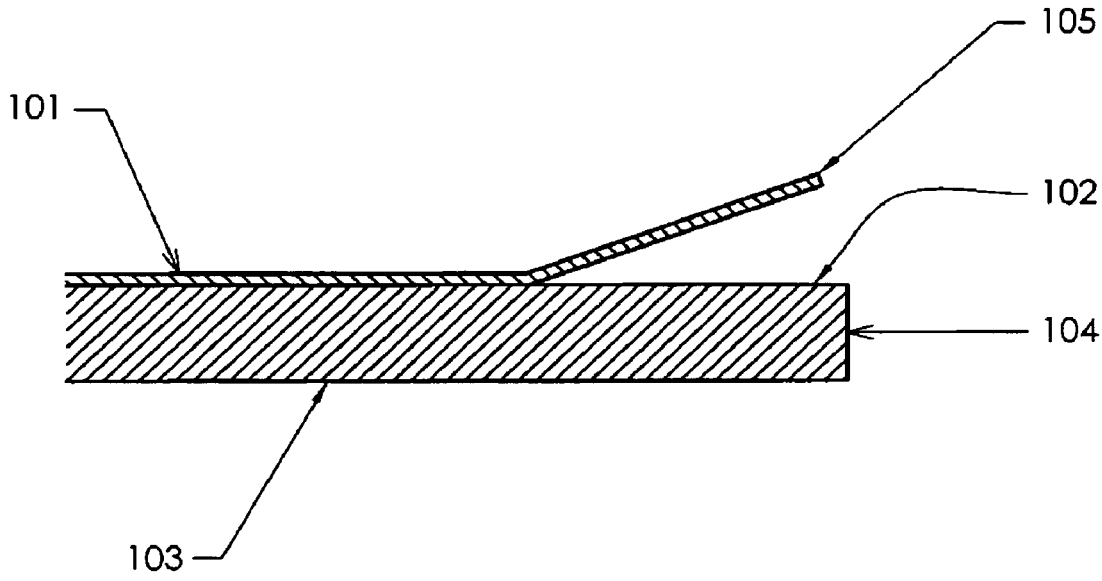
FIG. 2 is a detailed side view of a preferred embodiment of the present invention showing a molded pulp body and polyethylene laminate.

Referring to FIGS. 1 and 2, a paint tray 101 is disclosed constructed of recycled molded pulp and comprising a first (upper) side 102 and a second (lower) side 103. Preferably, the pulp is made from post-consumer waste paper, newspaper and carton paper. The pulp may include water resistant chemical agents, such as gum resin. The water resistant chemical agents are typically added into the slurry during the formation of the pulp paint tray or other item. The water resistant chemical agents in the list are typically added in the range of 1 to 10% by weight and will help harden the pulp during the drying process by avoiding moisture, absorption in humid conditions. Without water resistant additives, the pulp may become too soft and lose its structural integrity. The pulp is molded into the form of a standard paint tray, for example a tray adapted for use with nine-inch paint rollers, with total dimensions of approximately 27×32×42 cm.

Figure 4:
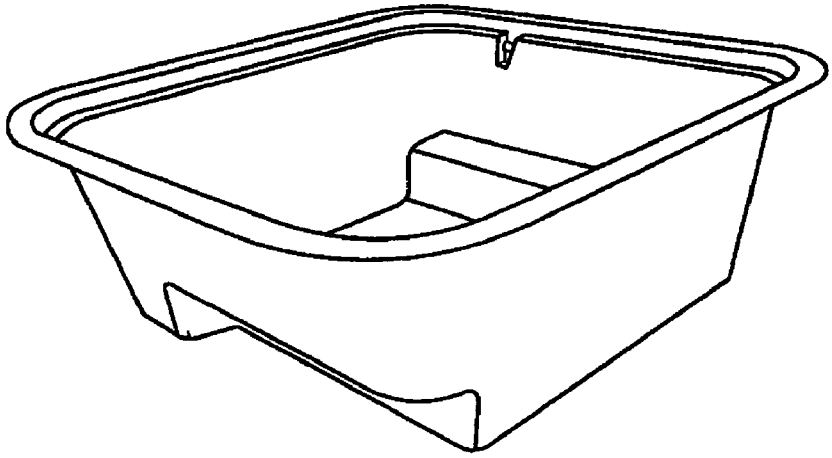
FIG. 4 is a perspective view of a trim tray that can be manufactured of laminated molded pulp.
Figure 5:
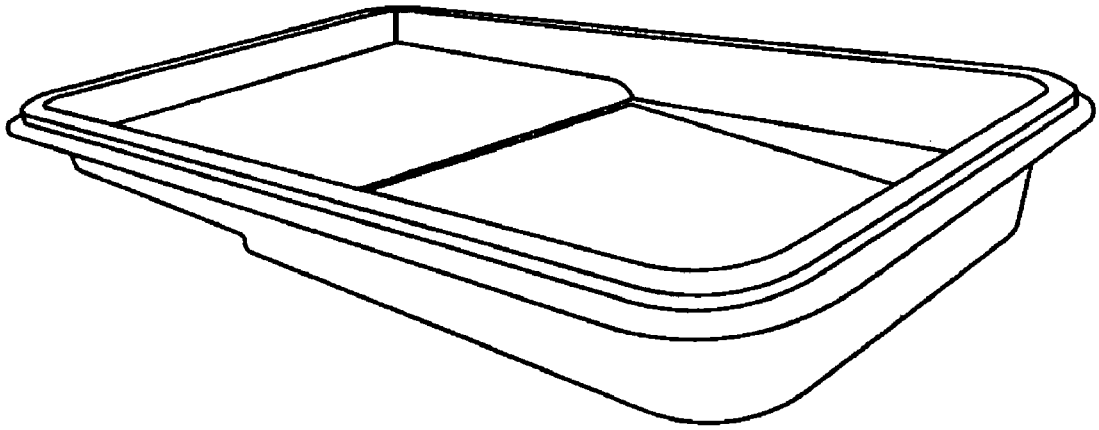
FIG. 5 is a perspective view of a paint edger tray that can be manufactured of laminated molded pulp.
Figure 6:
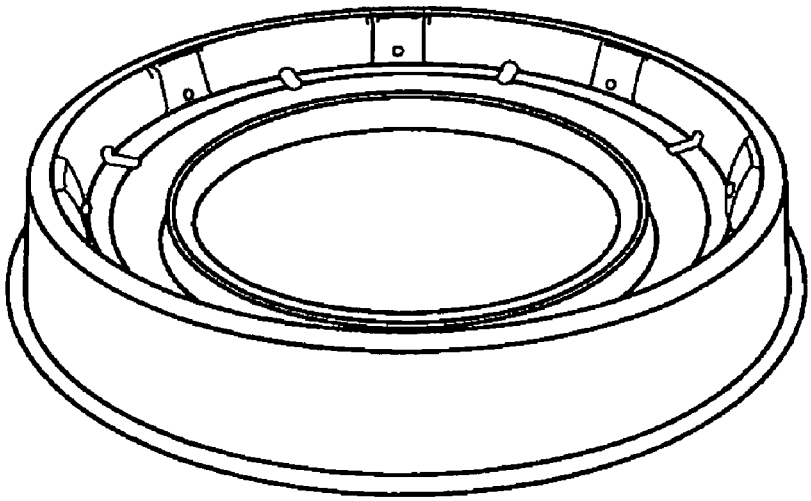
FIG. 6 is a perspective view of a drip catcher that can be manufactured of laminated molded pulp.
Figure 7:
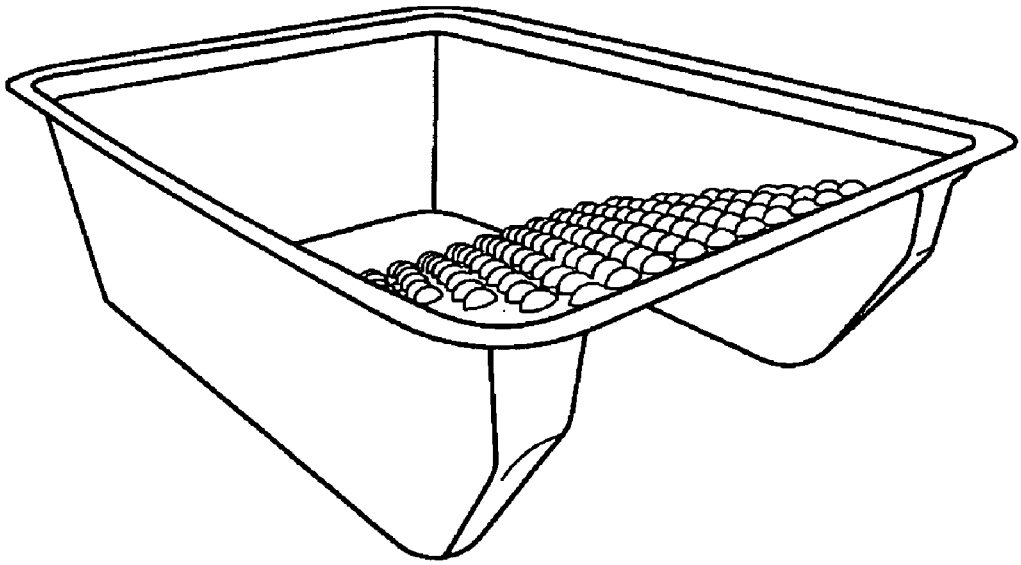
FIG. 7 is a perspective view of a mini roller tray that can be manufactured of laminated molded pulp.
Figure 8:
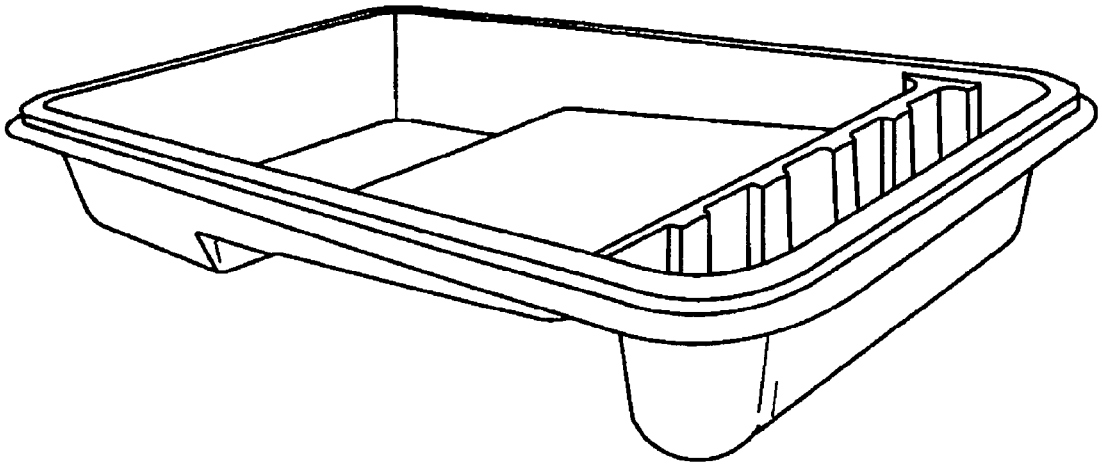
FIG. 8 is a perspective view of a six-inch roller tray that can be manufactured of laminated molded pulp.
Figure 9:
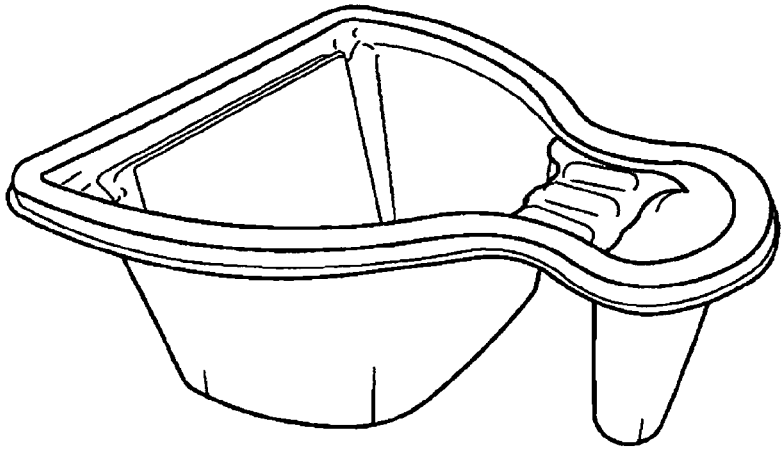
FIG. 9 is a perspective view of a paint trim cup that can be manufactured of laminated molded pulp.
Figure 10:
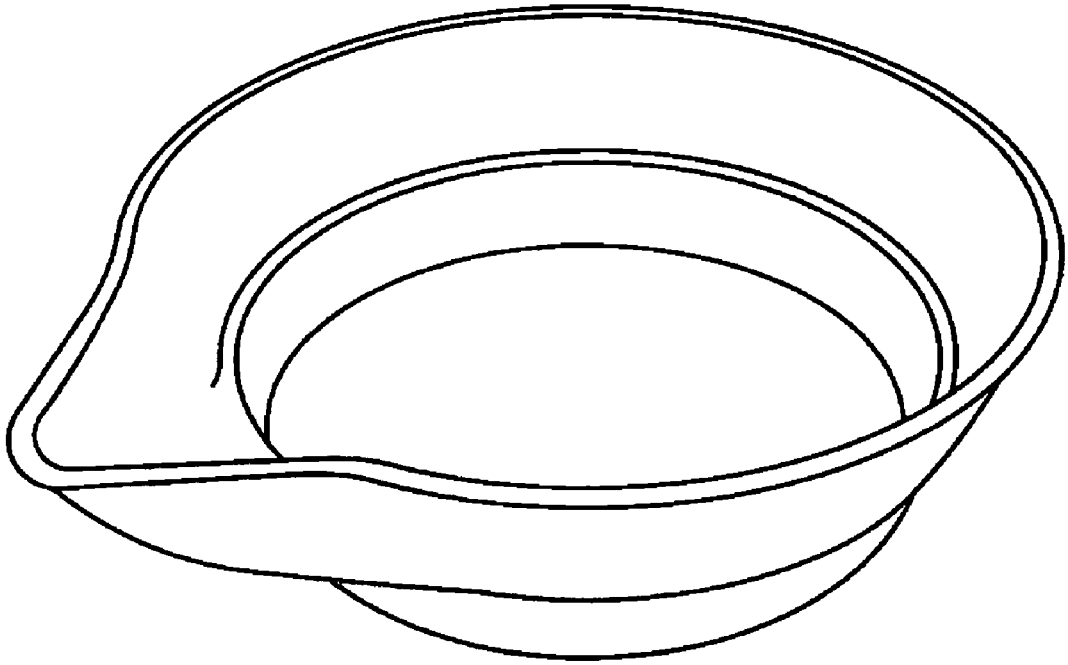
FIG. 10 is a perspective view of a pour spout that can be manufactured of laminated molded pulp.

Other suitable applications may include a paint trim tray with dimensions of 8.3×8.5 in. (FIG. 4), a tray for use with a paint edger (FIG. 5), a drip catcher with dimensions of 8.5×8.0 in. (FIG. 6) sized for use with both quart and gallon-size paint cans, a mini roller tray (FIG. 7), a 6-inch roller tray with dimensions of 12.0×10.5 in. (FIG. 8), a paint trim cup (FIG. 9), and a disposable pour spout (FIG. 10) adapted to attach to the rim of a paint can to allow easy pouring. Each of these may vary somewhat in size and shape while still performing the desired functions.

The pulp is molded to a preferable thickness of between 1 to 2 mm, depending on the structural requirements throughout the tray. For instance, the thickness can be adjusted to accommodate both the flat portions of the tray and any curved portion of the tray. Thickness on different parts can be adjustable to reduce the destruction of natural fiber which provides natural rigidity to promote proper structural integrity.

The pulp tray is then laminated on only the first side 102 with poly film 105, preferably recycled from 100% post-consumer material, to a preferred thickness of between 0.02 and 0.17 mm. This lamination may be accomplished by the use of a process such as that disclosed in WO/2001/074564 ('564), which is incorporated herein by reference. The thin poly film coating makes the first side 102 substantially impermeable to moisture, so the paint tray 101 can be used to hold paint without losing its rigidity or deteriorating. But the second side 103 is still able to absorb moisture and start the normal degradation process. So when the user is finished, he can discard the tray, and the pulp will begin to biodegrade from the second side 103. Within a short time, the molded pulp body 104, which constitutes the greatest bulk of the mass and volume of the paint tray 101, will have biodegraded, leaving only the very thin, non-rigid poly film. The residual film will constitute only a minuscule fraction of the waste left by a wholly-plastic disposable paint tray.

The resultant benefit of a paint tray composed primarily of molded pulp fiber is twofold. One, the immediate benefit comes at the time of purchase in that the bulk of the product has already been manufactured from recycled post-consumer waste bio-products. This in itself is a major contribution to the environment in that each purchase is one less purchase of a non-biodegradable plastic tray deemed to last forever.

The second benefit arrives when the product is discarded. Unlike plastic trays composed of 100% non-biodegradable plastic, the molded pulp fibers, which compose the bulk of the tray content, immediately begin their decomposing process, leaving only a very thin film, inconsequential in substance.

Figure 3:
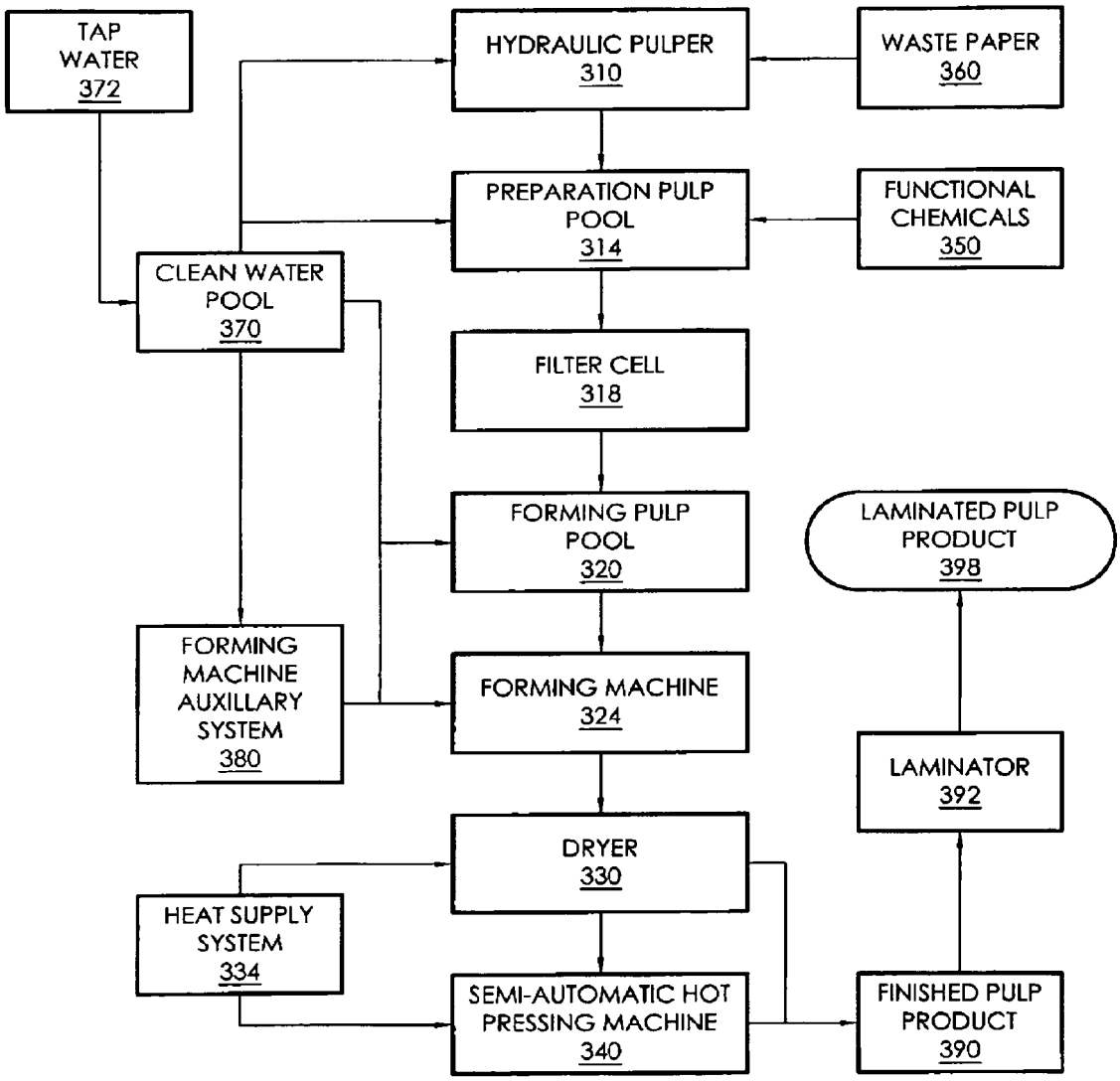
FIG. 3 is a flowchart illustrating the process of converting recycled paper waste pulp to a laminated pulp product.

FIG. 3 discloses a process for creating molded pulp. The processes are generally known in the art. For example, molded and laminated articles have been used in the food industry for some time. However, the food industry has specific requirements, including those relating to hygiene, which dictate certain materials and processes such as food grade virgin pulp, required to meet FDA requirement. For example, while the '564 publication disclosed above illustrates the use of a clean room for lamination, none would be required for the products set forth herein. For example, certain ingredients in the pulp recipe may be eliminated, such as certain oil-resistant chemical agents. Nonetheless, reference is generally made to food industry processes and trays for comparison purposes.

Applicant typically uses an out mold drying process which sun dries pulp molds in non-humid conditions (typically 6-8 hours). Oven drying may be used in inclement weather conditions.

The discussion set forth herein and herein below will assume familiarity with the lamination process using the food industry and, for example, set forth in the '564 publication. Applicant's product and process typically includes a poly laminate which will adhere to the molded pulp without the use of glue, which glue may be an additional non-biodegradable substance.

In the molding process, waste paper 360 is provided to a hydraulic pulper 310, which provides pulp to a preparation pulp pool 314. Functional chemicals 350 and clean water 372 from the clean water pool 370 are also added. Clean water 372 may be provided as ordinary municipal tap water. The pulp output of preparation pulp pool 314 is then filtered in filter cell 318, and pooled in forming pulp pool 320. Forming pulp is provided to forming machine 324, which includes auxiliary systems 380. Forming machine 324 provides a formed mold, which is then dried in a dryer 330. Heat may be provided to the dryer from a heat supply system 334. In some cases, the heat provided to the dryer 330 will be sunlight. In other cases, it may be an artificial heat source. Standard quality products may be provided directly from the dryer as finished pulp products 390. But higher-quality pulp products will also need to be processed by a semiautomatic hot pressing machine 340. Finished pulp products 390 are provided to laminator 392, which laminates the molded pulp with one of the films discussed above to provide a laminated pulp product 398.

The poly film is applied in laminator 392 in ways known in the art. The poly film is provided in a thickness of 0.02 to 0.17 mm and may be stretched to between 3 to 5 times its original dimensions before application. It will typically be heated in the range of about 350° C. to about 550° C. in the lamination machine, then using a die press, it is heat pressed into the molded product. The heat press may typically be heated from 150° C. to 200° C. for 10 to 60 seconds. Stretching the film prior to molding may help provide coverage in the peaks and valleys of the molded form.

The current process allows the poly film to be easily removed from the molded pulp fiber paint tray to recycle (along with any dried paint). This may be accomplished by using a suitable poly film, such as those set forth above, or PET film with a thickness between 0.02 mm and 0.2 mm.

With the proper heat bonding, and without glue, the tray or other container has a laminate adheres sufficiently to the molded pulp to avoid falling out in normal handling or under the influence of gravity. But because no glue is used, with the use of the proper poly film and heat sealing as set forth above, one can easily remove the film from the finished tray, as by the edges along the flange.

While a paper tray has been discussed and disclosed, Applicant's novel product and method may also be used on other industrial residential products, including: trim tray, drip catcher, mud tray, paint tray, kitty litter tray, flower pot and oil tray. Any of these may be produced with a molded pulp thickness of 1 to 2 mm, and a laminate thickness of 0.02 mm to 0.2 mm.

A typical product's content will be composed of at least 95% biodegradable recycled pulp fiber used in the manufacture of the molded article. A laminate would typically represent 5% or less by weight. A PET or PE poly film disclosed herein is unique in that it is 100% recyclable and 40% biodegradable. As such, the biodegradable content of the overall tray consisting of 100% biodegradable fiber pulp and 5% PET/PE poly film of which is 40% biodegradable will be approximately 97% biodegradable; 3% non-biodegradable and 100% recyclable. It is one intention of Applicant's novel product to allow the poly laminate film, whether or not biodegradable, to be easily removable by the consumer or end user and separable such that the laminate film may be recycled and the 100% biodegradable pulp product can be discarded without environmental guilt. Further, as in the case of a paint tray, the poly laminate may have used paint adhered to it, which typically would not prevent the recycling, but may inhibit biodegradability.

Although the invention has been described in connection with the preferred embodiment, it is not intended to limit the invention's particular form set forth, but on the contrary, it is intended to cover such alterations, modifications, and equivalences that may be included in the spirit and scope of the invention as defined by the appended claims.

What is claimed is:

1. A tray for holding a liquid paint therein, the tray comprising:

a molded pulp portion with side walls and a bottom wall comprising at least partially recycled paper and water resistant ingredients, the water resistant ingredients including gum resin added to the recycled paper;

a poly film laminate portion comprising a poly film, the poly film having a melting temperature between 350 and 550° Celsius and capable of being stretched to between 300 and 500% of its original length;

wherein the molded pulp portion is between about 0.2 mm and 2 mm thick in planar areas and about twice that thickness in non-planar areas or curved regions; and wherein the laminate is between about 0.02 and 0.2 mm thick and applied by heat press atop the molded pulp portion without glue between the molded pulp portion and the laminate.

2. The tray of claim 1, wherein the poly film comprises a material selected from the group consisting of polyethylene teraphthalate, polypropylene, polyethylene, or nylon.

3. The tray of claim 1, wherein the laminate is applied by the heated press at a temperature between 150 and 250° Celsius for a time of 10 to 60 seconds.

4. The tray of claim 1, wherein the poly film laminate is at least partially recyclable, at least partially degradable, and constructed of at least 50% recycled raw material.

5. The tray of claim 1, wherein the laminate is easily removable from the molded pulp portion by a user without the aid of tools.

6. An environmentally-advantageous tray for holding liquid paint comprising:

a pulp tray constructed of recycled molded pulp of between 1 and 2 mm thickness and comprising a first upper side and a second lower side, the pulp comprising post-consumer waste paper and between 1 and 10% water-resistant chemical agent, the tray molded into a configuration selected from the group consisting of a nine-inch roller tray with dimensions 27×32×42 cm, a trim tray with dimensions 8.3×8.5 in., a paint edger, a drop catcher of dimensions 8.5×8.0 in., a mini-roller tray, a 6-inch roller tray with dimensions 12.0×10.5 in., a paint trim cup, and a disposable pour spout; and a polylaminate film applied to the first side of the pulp tray, the film constructed of 100% post-consumer material selected from the group consisting of polyethylene teraphthalate, polypropylene, polyethylene, polylactic acid, low-density polyethylene, high-density polyethylene, and nylon; the film being between 0.02 and 0.2 mm thick.

* * * * *